US006895785B2

(12) United States Patent
Morita

(10) Patent No.: US 6,895,785 B2
(45) Date of Patent: May 24, 2005

(54) YARN CARRIER OF WEFT KNITTING DEVICE

(75) Inventor: Toshiaki Morita, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 10 days.

(21) Appl. No.: 10/473,369

(22) PCT Filed: Mar. 27, 2002

(86) PCT No.: PCT/JP02/03019

§ 371 (c)(1),
(2), (4) Date: Sep. 30, 2003

(87) PCT Pub. No.: WO02/081800

PCT Pub. Date: Oct. 17, 2002

(65) Prior Publication Data

US 2004/0093911 A1 May 20, 2004

(30) Foreign Application Priority Data

Mar. 30, 2001 (JP) ..... 2001-099105

(51) Int. Cl.[7] ..... D04B 15/52
(52) U.S. Cl. ..... 66/126 R
(58) Field of Search ..... 66/126 A, 126 R, 66/127, 128, 129, 130, 133, 138, 139

(56) References Cited

U.S. PATENT DOCUMENTS 4,354,363 A * 10/1982 Inoue ..... 66/128
4,738,124 A * 4/1988 Stoll et al. ..... 66/127
5,109,681 A * 5/1992 Schmid et al. ..... 66/126 R
5,345,789 A 9/1994 Yabuta
6,021,651 A * 2/2000 Shima ..... 66/126 A
6,047,570 A 4/2000 Shima
6,647,749 B2 * 11/2003 Ikoma ..... 66/126 A

FOREIGN PATENT DOCUMENTS

| | | |
|---|---|---|
| DE | 4407708 | 9/1995 |
| DE | 4407708 A1 | 9/1995 |
| EP | 331 650 | 9/1989 |
| EP | 898 002 | 2/1999 |
| JP | 62-11988 | 3/1987 |
| JP | 3-23662 | 3/1991 |
| JP | 2807848 | 7/1998 |
| JP | 2903152 | 3/1999 |
| JP | 2903152 | 6/1999 |

* cited by examiner

*Primary Examiner*—Danny Worrell
(74) *Attorney, Agent, or Firm*—Wenderoth, Lind & Ponack, L.L.P.

(57) ABSTRACT

A yarn carrier 1 is capable of being engaged with a pin 4 protruding from a carriage 3 at two engagement points 8, 9 separated by a delay amount ΔL with respect to a center 1*a*, respectively. Assuming that the carriage 3 approaches from the right with the pin 4 protruding in order to select and haul the yarn carrier 1 stationary on a yarn guide rail 2, the tip of the pin 4 is guided on a guide portion 11*b* of an oscillating piece 11, and a tip portion 11*c* prevents engagement with the engagement point 9 by making oscillation displacement about a shaft 11*a*. The pin 4 is guided to the engagement point 8 by guide portions 13*a*, 12*a* of oscillating plates 13, 12, and abuts on a tip portion 10*c* of an oscillating piece 10, which is engaged with the front side of the pin 4. The oscillating plate 12 also departs from the pin 4, and a tip portion 12*c* ascends to be engaged with the rear side of the pin 4.

6 Claims, 11 Drawing Sheets

YARN CARRIER OF WEFT KNITTING DEVICE

TECHNICAL FIELD

The present invention relates to a yarn carrier of a weft knitting apparatus which supplies knitting yarn to a knitting needle performing a knitting operation in a needle bed.

BACKGROUND ART

Conventionally, in a weft knitting apparatus in which a knitting needle in a needle bed is made to perform a knitting operation by a cam mechanism while a carriage runs to and fro in the longitudinal direction of the needle bed, a yarn carrier is used so as to supply knitting yarn to the knitting needle while moving in conjunction with the carriage. The yarn carrier is also referred to as a yarn feeder or a yarn guide. The yarn carrier moves along a yarn guide rail which is installed above the needle bed and parallel with the longitudinal direction of the needle bed. The carriage and the yarn carrier are linked to each other by a pin which is disposed to the carriage and capable of appearing toward the yarn carrier. The weft knitting apparatus is provided with a plurality of yarn guide rails. To one yarn guide rail, a passage for one yarn carrier or passages for a plurality of yarn carriers can be disposed. The carriage is provided with pin appearing mechanisms for a plurality of passages and capable of selecting a yarn carrier by making the pin appear.

FIG. 11 shows a simplified construction of a conventional and typical yarn carrier 51. The yarn carrier 51 is capable of running along a yarn guide rail 52, and is engaged with a pin 54 protruding from a carriage 53 and hauled. Below a casing 55 of the yarn carrier 51, a feeder rod 56 is pendent, and a yarn feeding port 57 is disposed to the tip thereof. On the upper face of the casing 55, a concave part 60 having engagement points 58, 59 to be engaged with the pin 54 on both sides thereof is formed. On both outer sides of the casing 55, guiding slopes 61, 62 are disposed. Since a cam which makes a knitting needle perform a knitting operation is substantially triangle, the two engagement points are necessary in order to make the yarn carrier 51 have a specified delay amount AL in accordance with a running direction of the carriage 53.

It is assumed that, in order to select the yarn carrier 51 stationary on the yarn guide rail 52, the carriage 53 is running toward the yarn carrier 51. The pin 54 protrudes from the carriage 53 and approaches the yarn carrier 51. The pin 54 is biased downward by a spring, and comes close to the concave part 60 while running onto the guiding slope 62. The pin 54 passes by the engagement point 59 on the rear side in the running direction, and the tip of the pin 54 abuts on the side wall face of the concave part 60 in the engagement point 58 on the front side in the running direction. After the point of time of abutting, the yarn carrier 51 is hauled by the carriage 53, thereby becoming movable. The applicant of this application has disclosed a yarn carrier provided with two engagement points in this manner in Japanese Patent Nos. 2807848, 2903152 and so on.

Since, as shown in FIG. 11, the yarn carrier 51 provided with the two engagement points 58, 59 moves in a state where the rear side thereof at the time of being hauled by the carriage 53 is not engaged with the pin 54 at all times, there is a possibility that, when the carriage 53 is suddenly stopped, the yarn carrier 51 goes ahead of the carriage 53 because of inertia. For this reason, for example, sliding resistance at the time when the yarn carrier 51 runs along the yarn guide rail 52 is set large so that, when a driving force from the pin 54 stops, the yarn carrier 51 also stops immediately. Therefore, it is necessary to transmit such a driving force that overcomes the resistance from the pin 54 to the engagement point 58 when making the yarn carrier 51 hauled.

In order to make it possible to transmit a large force from the pin 54, it is necessary to enlarge a driving force of the carriage 53. It is also necessary to strengthen and upsize an appearing mechanism of the pin 54 and so on. Abrasion of a sliding part between the yarn guide rail 52 and the yarn carrier 51 and so on also increases.

An object of the present invention is to provide a yarn carrier of a weft knitting apparatus which, even when having two engagement points, is capable of certainly engaging both sides of a pin from a carriage in the respective engagement points.

DISCLOSURE OF INVENTION

The invention provides a yarn carrier of a weft knitting apparatus which yarn carrier is selected by protruding a pin disposed to a carriage moving to one side or another side along a longitudinal direction of a needle bed of the weft knitting apparatus and capable of appearing, provided with two engagement points where a tip of the pin can be engaged spaced in the longitudinal direction in order to supply knitting yarn to the vicinity of a tip of a knitting needle performing a knitting operation, engaged with the tip of the pin in the engagement point on a front side in a running direction of the carriage, and hauled and moved by the carriage, the yarn carrier of the weft knitting apparatus comprising:

a pair of selection guiding members which are disposed so as to front the individual engagement points from the outside of the two engagement points in the longitudinal direction, respectively, and which selectively guide the pin so as to pass by the engagement point on a rear side in the running direction of the carriage and so as not to pass by the engagement point on the front side in the running direction of the carriage; and a guide blocking mechanism, disposed between the two engagement points, which guides the pin guided by the selection guiding member so as to pass by the engagement point on the rear side in the running direction to the engagement point on the front side in the running direction and which, when the pin reaches the front-side engagement point, makes displacement so as to prevent the pin from moving on the rear side relatively to the engagement point.

According to the invention, the yarn carrier is capable of running along a yarn guide rail installed above a weft knitting apparatus and in parallel with the longitudinal direction of a needle bed, has engagement points with which, when selected by a pin protruding from a carriage moving to one side or the other side along the longitudinal direction, the tip of the pin is engaged at two points spaced in the longitudinal direction, and comprises the pair of selection guiding members and the guide blocking mechanism. When a knitting needle performs a knitting operation, knitting yarn is supplied from the yarn carrier selected and hauled by the carriage to the vicinity of the tip of the knitting needle. The selection guiding members are disposed so as to front the individual engagement points from the outside of the two engagement points, respectively, and, when the carriage with the pin protruding runs and approaches from a state away from the carriage, guide the pin so as to pass by the engagement point on the rear side in the running direction of the carriage. The guide blocking mechanism guides the pin guided so as to pass by the rear-side engagement point by the selection guiding member, so as to move to the engagement point on the front side in the running direction, and when the pin reaches the front-side engagement point, makes displacement so as to prevent the pin from moving on the rear side relatively to the engagement point. Since the selection guiding member disposed to the front-side engagement point does not guide the pin having reached so as to pass further forward, the pin is engaged with the front-side engagement point, and the carriage runs while hauling the yarn carrier. Since, in the front-side engagement point, the guide blocking mechanism prevents the pin from moving on the rear side, the yarn carrier cannot move ahead of the pin in the running direction before stopping when the carriage stops, and it is possible to certainly stop the yarn carrier also. As a result, there is no need to increase sliding resistance or the like, and it is possible to move the yarn carrier with light load to the yarn guide rail.

Further, the invention is characterized in that, regarding the selection guiding members:

arms thereof are capable of making oscillation displacement about shafts disposed outside the engagement points so as to be perpendicular to a protruding direction of the pin and the running direction of the carriage, the arms extending from the shafts toward the engagement points;

on the upper faces of the arms, guide portions with which the pin makes contact when approaching the engagement point and which guide the tip of the pin to the engagement point while making oscillation displacement downward due to pressure of the tip of the pin are formed;

tip portions of the arms front the engagement points, and are capable of narrowing the engagement points by making oscillation displacement to prevent the tip of the pin from being engaged with the engagement point when the guide portion is pressured, and abutting on the tip of the pin to engage the pin with the engagement point when the guide portion is not pressured; and the arms are biased by smaller force than the pressuring force of the pin so that the guide portions make oscillation displacement upward.

According to the invention, when the carriage approaches with the pin protruding in order to select the yarn carrier, the tip of the pin makes contact with and pressures the guide portion on the upper face of the arm of the selection guiding member, causes the arm of the selection guiding member to make oscillation displacement, and prevents the pin from being engaged with the rear-side engagement point by the tip portion of the arm. Since the tip of the pin abuts on the tip portion of the selection guiding member in the front-side engagement point, the pin can be engaged.

Still further, the invention is characterized in that: the guide blocking mechanism has a pair of oscillating members which are disposed between the two engagement points and whose arms are capable of making oscillation displacement about shafts parallel with shafts of the selection guiding members, the arms extending from the shafts toward the engagement points;

the respective oscillating members have, on the upper faces of the arms, guide portions which guide the tip of the pin while making oscillation displacement downward due to pressure of the tip of the pin, from the rear-side engagement point where the pin is prevented from being engaged by oscillation displacement of the selection guiding member, to the front-side engagement point; and tip portions of the arms front the engagement points, when the tip portion of the selection guiding member is pressed down, are pressed down together, and when the pin passes by the tip portion to be engaged with the front-side engagement point, makes oscillation displacement upward to catch the pin with the tip portion of the selection guiding member.

According to the invention, of a pair of oscillating members, an oscillating member whose tip portion fronts the engagement point on the rear side in the running direction of the carriage is caused to make oscillation displacement downward by the tip portion of the selection guiding member, thereby guiding the pin prevented from being engaged with the rear-side engagement point along the guide portion on the upper face, and guiding forward. The tip of the pin moves from the oscillating member whose tip portion fronts the rear-side engagement point to the guide portion on the upper face of the oscillating member whose tip portion fronts the front-side engagement point, and guides the pin to the front-side engagement point while pressuring and pressing down the oscillating member. Since pressure to the oscillating member is stopped when the pin reaches the front-side engagement point, the tip portion of the oscillating member ascends, and can be engaged with the rear side of the pin.

Still further, the invention is characterized in that the oscillating member is capable of making displacement toward the shaft when load more than a predetermined standard is applied from the tip portion of the arm.

According to the invention, when load is applied to the front side of the pin engaged with the engagement point on the front side in the running direction from both the front side and the rear side, the oscillating member makes displacement toward the shaft thereof, so that it is possible to obtain a space that the pin runs over the tip portion of the selection guiding member disposed outside the front-side engagement point, and it is possible to easily detach the pin from the front-side engagement point.

Still further, the invention is characterized in that the selection guiding members are housed in concave parts disposed outside the engagement points, and capable of appearing to the respective engagement points, and guide so as to pass by the engagement point while the upper faces thereof abut on the tip of the pin in the state of protruding to the engagement points, and include springs which biases the selection guiding members so as to protrude from the concave parts toward the engagement points.

According to the invention, when the carriage approaches with the pin protruding in order to select the yarn carrier, engagement with the engagement point on the rear side in the running direction is prevented by the protruding selection guiding member, and the tip portion of the pin is guided forward in the running direction while abutting on the upper face of the selection guiding member. When passing by the rear-side engagement point, the pin is guided to the front-side engagement point by the guide blocking mechanism, abuts on the tip portion of the selection guiding member in the front-side engagement point, pushes the selection guiding member into the concave part, and can be engaged.

Still further, the invention is characterized in that:

the guide blocking mechanism includes an ascending and descending member which is disposed below between the two engagement points and capable of making ascent and descent displacement and springs which bias the ascending and descending member upward, and guides the pin from the engagement point on the rear side in the running direction to the front-side engagement point in the state pressed down by the pin while the upper face of the ascending and descending member makes contact with the tip of the pin; and when the pin reaches the engagement point on the front side in the running direction, abuts on the tip of the selection guiding member and pushes the selection guiding member back into the concave part, and pressure to the upper face of the ascending and descending member by the pin is stopped, the ascending and descending member ascends, and the tip of the pin is caught between a side end face on the front side in the running direction and the tip of the selection guiding member on the front side of the engagement point.

According to the invention, when the pin is prevented from being engaged with the engagement point on the rear side in the running direction and passes by the rear-side engagement point, the pin is guided forward while the upper face of the ascending and descending member abuts on the tip of the pin. Since pressure to the ascending and descending member is stopped when the pin reaches the front-side engagement point, the ascending and descending member ascends due to bias by the springs, and can engage the rear side of the pin on the front-side side end face.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Referring to appended drawings, preferable embodiments of a yarn carrier of a weft knitting apparatus according to the present invention will be described below.

Figure 1:
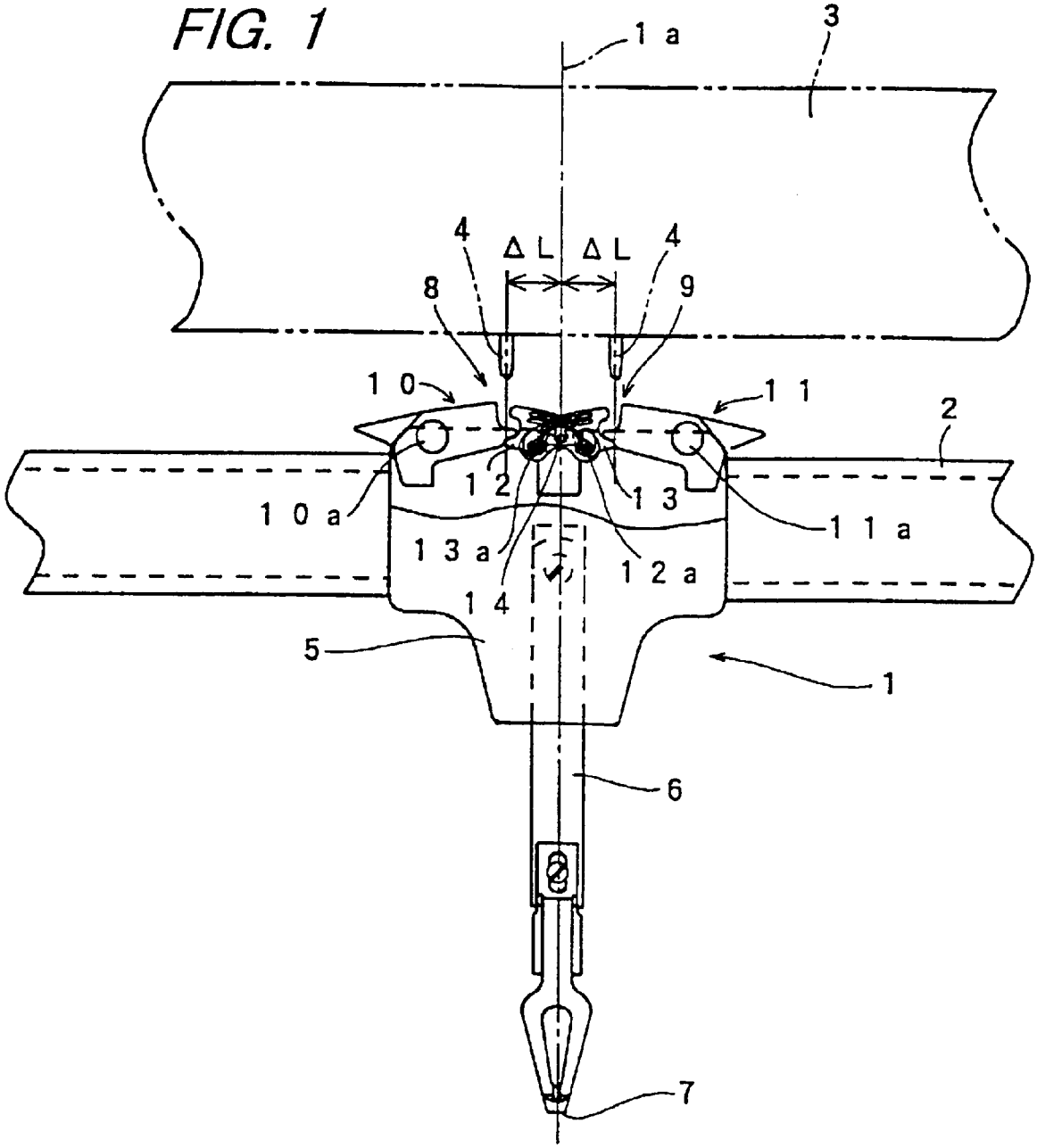
FIG. 1 is a front view showing, in section, part of a schematic construction of a yarn carrier 1, which is an embodiment of the present invention.

FIG. 1 shows, in section, part of a schematic construction of a yarn carrier 1, which is an embodiment of the invention. The yarn carrier 1 is capable of running in both to and fro directions along a yarn guide rail 2 which is installed above a needle bed of a weft knitting apparatus and in parallel with the longitudinal direction of the needle bed. The yarn carrier 1 is selected by a pin 4 capable of appearing from a carriage 3, engaged with the protruding-state pin 4, and hauled. Below a casing 5 of the yarn carrier 1, a feeder rod 6 is pendent. A yarn feeding port 7 is disposed to the tip of the feeder rod 6 and capable of supplying yarn to a teeth port between rear and front needle beds of the weft knitting apparatus.

On the upper face of the casing 5, engagement points 8, 9 to be engaged with the pin 4 are formed. On both outer sides of the casing 5, a pair of oscillating pieces 10, 11 serving as selection guiding members are disposed. The individual oscillating pieces 10, 11 have shafts 10*a*, 11*a* outside the two engagement points 8, 9, respectively, and are capable of making oscillation displacement about the shafts 10*a*, 11*a*. Between the engagement points 8, 9, there is an interval for obtaining a specified delay amount $\Delta L$ with respect to a center 1*a* of the yarn carrier 1. In this interval of $2\Delta L$, a pair of oscillating plates 12, 13 are disposed as a guide blocking mechanism. The oscillating plates 12, 13 are capable of making oscillation displacement about shafts 12*a*, 13*a* placed within the interval, respectively. The oscillating pieces 10, 11 and the oscillating plates 12, 13 are biased by springs which are not shown in the views, respectively, so that the tip portions thereof oscillate upward about the shafts 10*a*, 11*a* and the shafts 12*a*, 13*a*. In order to restrict ascents of the oscillating plates 12, 13, a common restriction pin 14 is disposed at the center.

Figure 2:
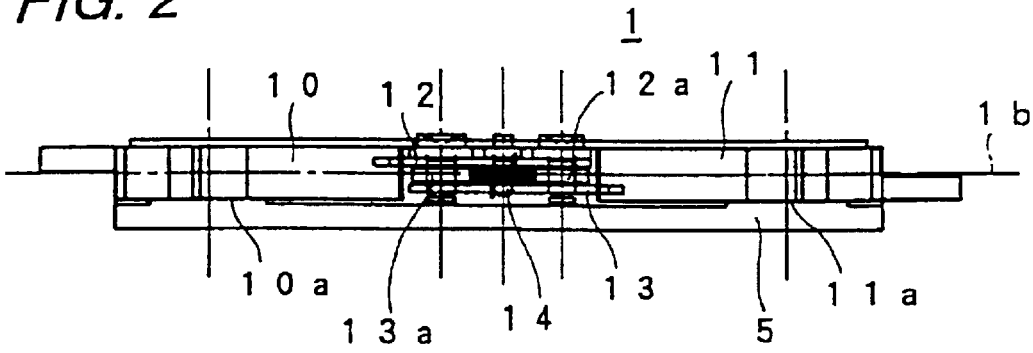
FIG. 2 is a magnified plan view showing the yarn carrier 1 of FIG. 1.

FIG. 2 shows a magnified plan-view state of the yarn carrier 1 of FIG. 1. The oscillating pieces 10, 11, the oscillating plates 12, 13 or the like are placed symmetrically about the intersection of the longitudinal center line 1*a* and a lateral reference line 1*b* of the yarn carrier 1. As a result, as described later, when a plurality of yarn carriers 1 are aligned on the single yarn guide rail 2, the end portion of the oscillating piece 10 of one yarn carrier 1 gets in the end portion of the oscillating piece 11 of an adjacent yarn carrier 1, thereby being capable of detaching the engaged pin 4.

FIGS. 3A to 3D show, by magnifying, an operation at the time when the carriage 3 selects the yarn carrier 1 of FIG. 1. Here, for the sake of convenience of explanation, regarding the oscillating plates 12, 13, one to be explained is displayed on the front side, and the rear-side one is simply shown. Moreover, although a case of running to the left in the view is shown, a case of running to the right in the view is the same. The yarn carrier 1 is stationary on the yarn guide rail 2 until selected.

Figure 3A:
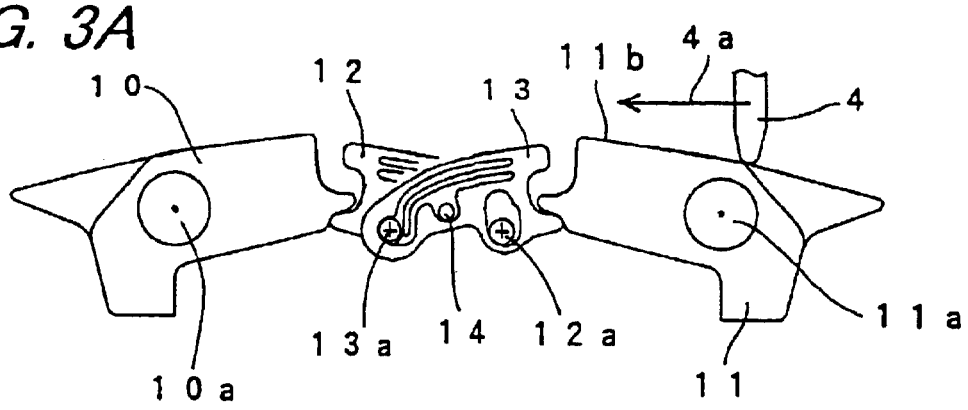
FIGS. 3A to 3D are magnified partial front views showing an operation at the time when a carriage selects the yarn carrier of FIG. 1.

As shown in FIG. 3A, the pin 4 moves in a running direction 4*a* in accordance with a run of the carriage. The oscillating plates 12, 13 are biased by springs so that the tip portions thereof ascend about the shafts 12*a*, 13*a*. Below the tip portions of the oscillating plates 12, 13, the oscillating plates 12, 13 make oscillation displacement so as to make the tip portions of the oscillating pieces 10, 11 ascend, respectively. The upper limits of ascents of the oscillating plates 12, 13 are restricted by the common restriction pin 14.

Figure 3B:
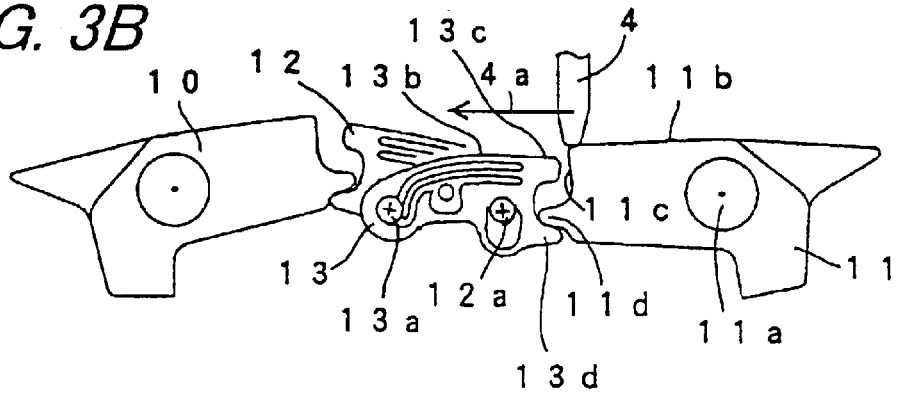

As shown in FIG. 3B, when the pin 4 approaches a tip portion 11*c* from a guide portion 11*b* which is the upper face of an arm of the oscillating piece 11 on the rear side in the running direction 4*a*, the tip portion 11*c* is pressed by the pin 4 and displaced downward because of oscillation displacement about the shaft 11*a*. Moreover, by a lower portion 11*d* of the tip portion 11*c*, the lower portion of a tip portion 13*c* of the opposite oscillating plate 13 is also pressed down, and the rear-side engagement point is closed. The pin 4 moves from the guide portion 11*b* of the oscillating piece 11 to a guide portion 13*b*, which is the upper face of an arm of the oscillating plate 13.

Figure 3C:
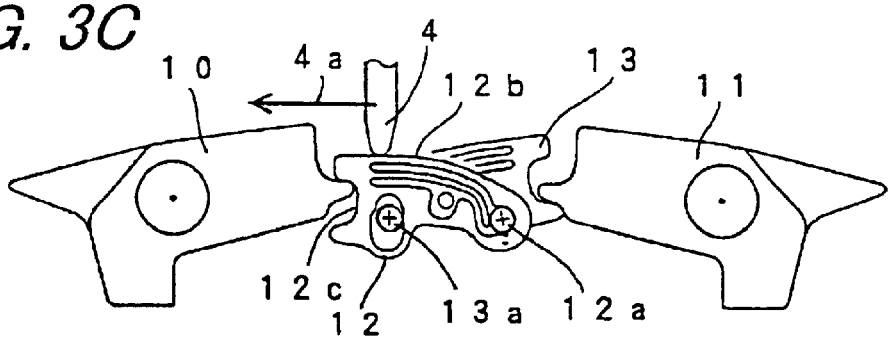

As shown in FIG. 3C, the pin 4 continues to move in the running direction 4*a*, and then the pin 4 moves to a guide portion 12*b* of the upper face of an arm of the oscillating plate 12 whose tip portion 12*c* fronts the front-side engagement point. When the pin 4 comes close to a tip portion 12*c* of the oscillating plate 12, the tip portion 12*c* is pressed down. However, the front-side oscillating piece 10 is pressed down little.

Figure 3D:
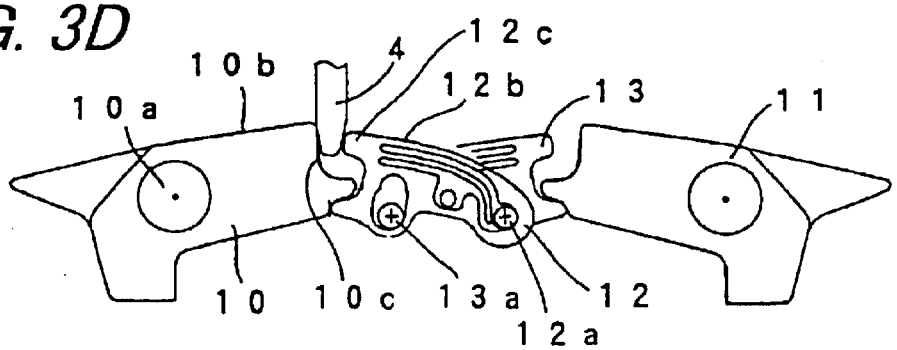

As shown in FIG. 3D, when abutting on a tip portion 10*c* of the front-side oscillating piece 10, the pin 4 departs from the guide portion 12*b* of the oscillating plate 12 and stops pressuring the oscillating plate 12. As a result, the tip portion 12*c* of the oscillating plate 12 ascends to be engaged with the rear side of the pin 4. The pin 4 is engaged with the tip portion 10*c* of the oscillating piece 10 on the front side and the tip portion 12*c* of the oscillating plate 12 on the rear side, respectively. In this state, engagement between the carriage and the yarn carrier 1 via the pin 4 is completed. After engagement is completed, the yarn carrier 1 is hauled by the carriage. When approaching from the opposite direction to the running direction 4*a*, the pin 4 is guided by a guide portion 10*b* of the upper face of an arm of the oscillating piece 10 at first.

Figure 4:
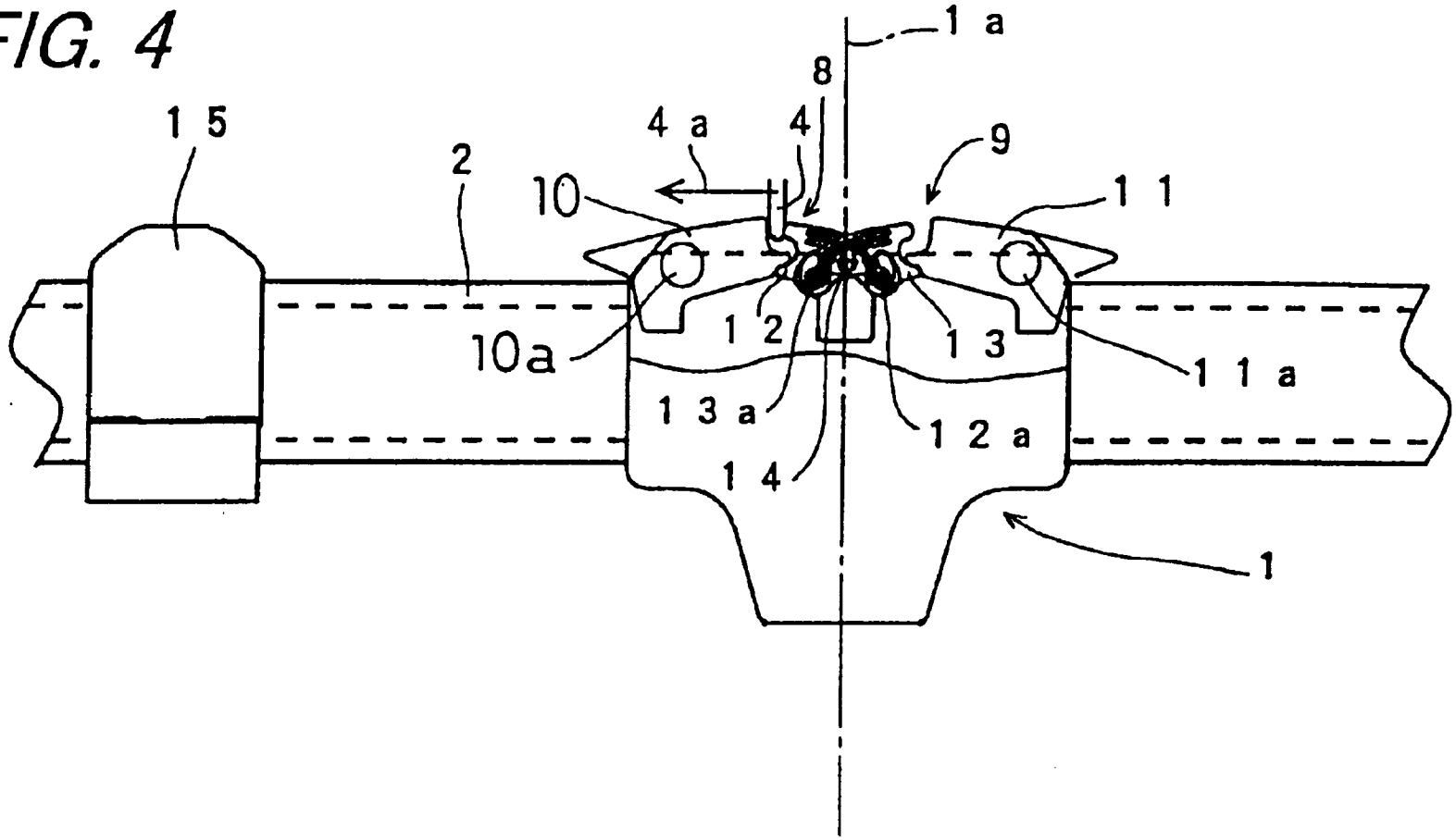
FIG. 4 is a partial front view showing a state where a stopper 15 is disposed to an end portion of a yarn guide rail 2 on which the yarn carrier 1 of FIG. 1 runs.

FIG. 4 shows a state that a stopper 15 is disposed at the end of the yarn guide rail 2 where the yarn carrier 1 of FIG. 1 runs. The yarn carrier 1 is stationary in an arbitrary position in a case where the carriage pulls in the pin 4, whereby it is possible to stop the carriage hauling the yarn carrier 1. However, making the yarn carrier 1 wait in a specified waiting position is preferable to making the yarn carrier 1 stationary in an arbitrary position, in terms of simplification of control and so on. In order to accurately stop the yarn carrier 1 at the stopper 15 and remove the pin 4 from the engagement point 8 naturally, the engagement plates 12, 13 of this embodiment are also capable of making displacement in the directions of the shafts 12*a*, 13*a*.

Figure 5:
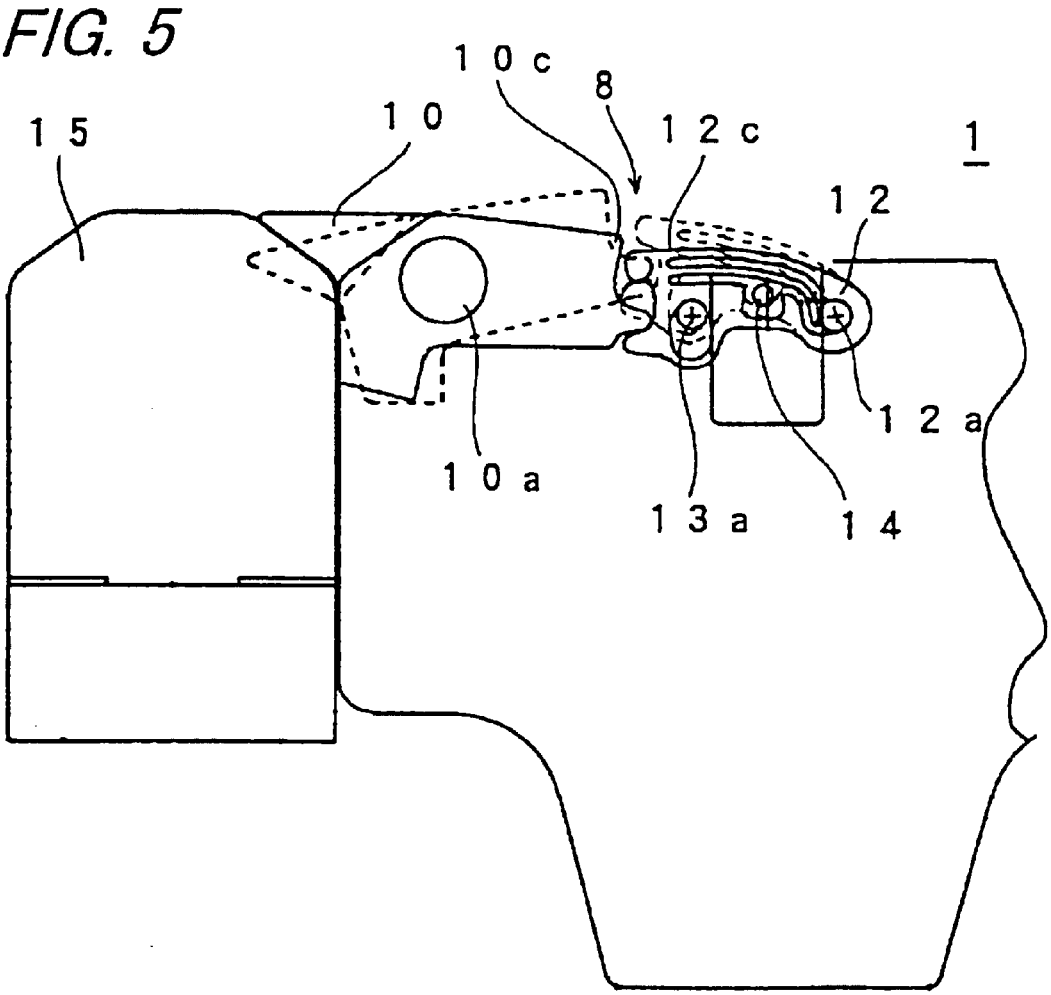
FIG. 5 is a magnified partial front view showing a state where the yarn carrier 1 is stopped by the stopper 15 of FIG. 4.

FIG. 5 shows, by partially magnifying, displacement of the oscillating piece 10 and the oscillating plate 12 at the time when the yarn carrier 1 abuts on the stopper 15 shown in FIG. 4. A dot line shows a state in FIG. 4, and a solid line shows a state of abutting on the stopper 15. When the yarn carrier 1 approaches the stopper 15 in the state shown by the dot line, the tip portion 10*c* of the oscillating piece 10 presses the pin on the rear side to make oscillation displacement downward. The tip portion 12*c* of the oscillating plate 12 is pressed and displaced toward the shaft 12*a* by the pin, engagement with the pin in the engagement point 8 is released, and the pin runs onto the guide portion 10*b* from the tip portion 10*c* of the oscillating piece 10 and escapes forward.

Figure 6A:
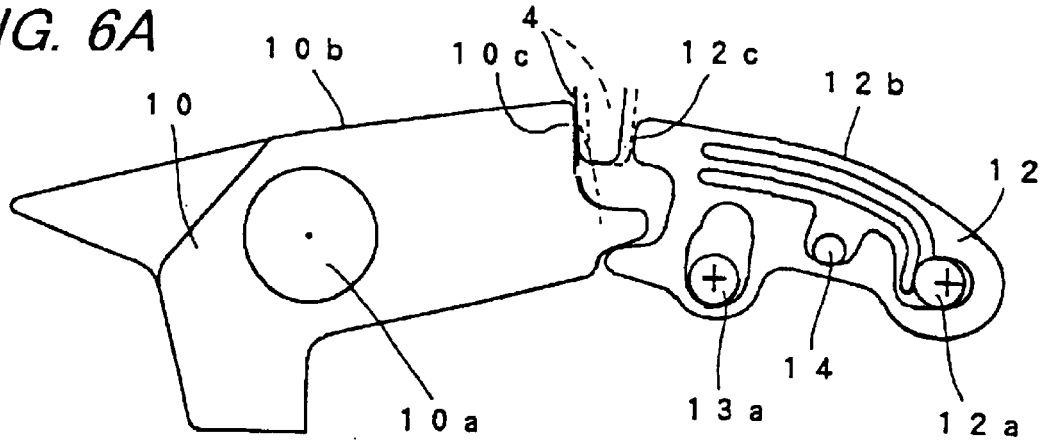
FIGS. 6A to 6C are magnified partial front views showing an operation at the time when engagement of a pin 4 is released when the yarn carrier 1 is stopped by the stopper 15 of FIG. 4.
Figure 6B:
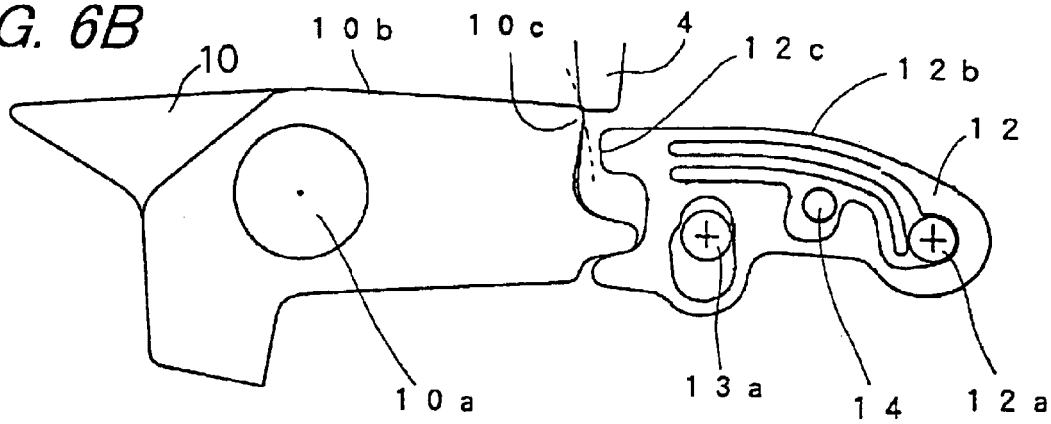
Figure 6C:
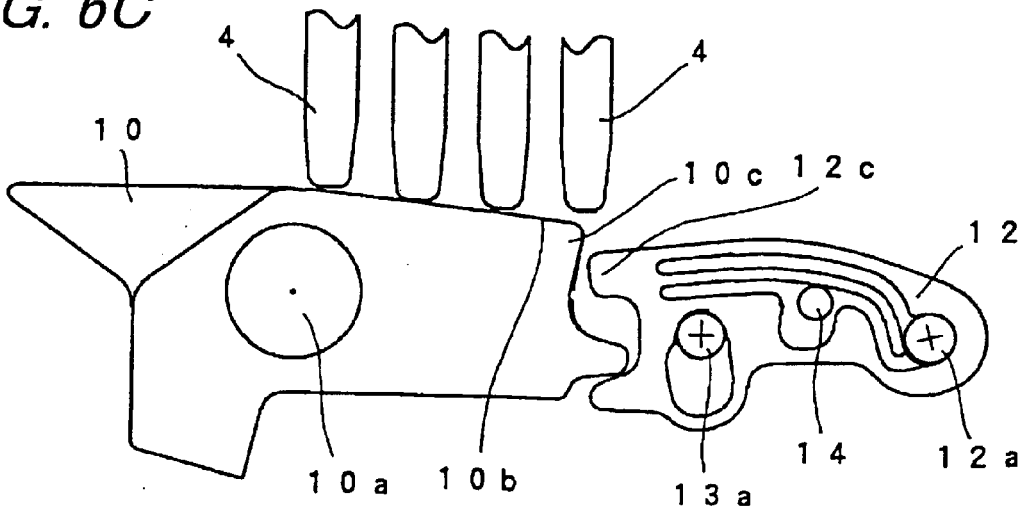

FIGS. 6A to 6C show a process that the pin 4 protruding from the carriage continuing to move escapes from the engagement point in a state where the yarn carrier 1 abuts on the stopper 15 as shown in FIG. 5 and stops. FIG. 6A shows a state that, when the front-side oscillating piece 10 is pressured by the stopper 15 shown in FIG. 4 and the tip portion 10*c* makes oscillation displacement as shown by a broken line, the pin 4 abutting on the tip portion 10*c* of the front-side oscillating piece 10 as shown by a solid line is pressured on the rear side and displaced to a position shown by a broken line and the oscillating plate 12 is displaced on the rear side. Since the position of the pin 4 in the engagement point 8 shifts toward the oscillating plate 12, the oscillating piece 10 makes such oscillation displacement that the tip portion 10*c* descends more by pressure from the side slope of the stopper 15, whereby the pin 4 easily runs onto the guide portion 10*b* from the tip portion 10*c*. When running onto the guide portion 10*b* as shown in FIG. 6B, the pin 4 can easily pass on the guide portion 10*b* and escape outside as shown by the use of a plurality of pins 4 in FIG. 6C.

Figure 7:
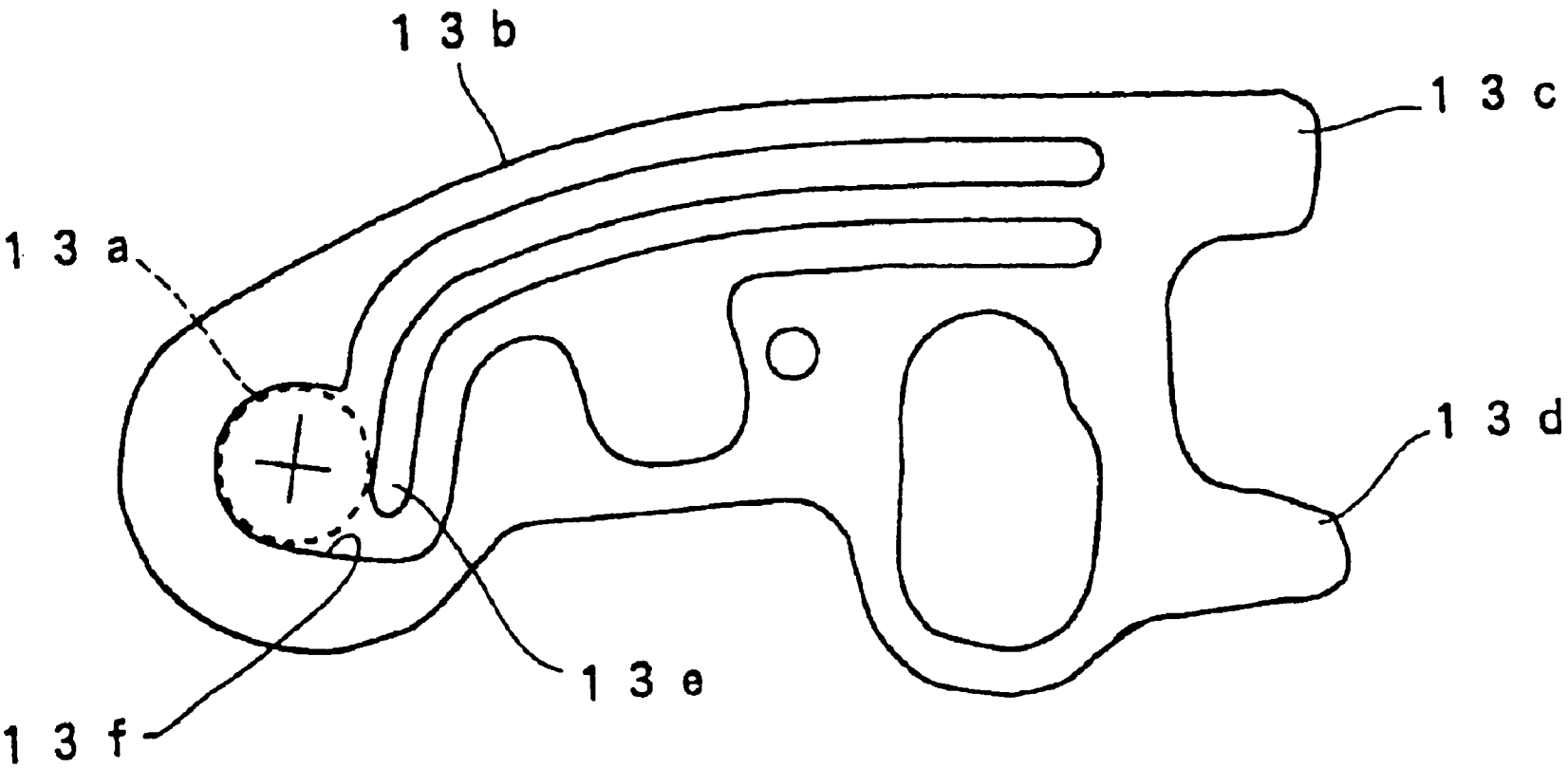
FIG. 7 is a front view of an oscillating plate 13 of FIG. 1.

FIG. 7 shows the oscillating plate 13 of FIG. 1 by magnifying. The other oscillating plate 12 is the same basically. The oscillating plate 13 is made of an elastic metal plate. Inside the oscillating plate 13, a spring portion 13*e* is formed, and the tip thereof fronts a shaft hole 13*f* into which the shaft 13*a* is pierced. When load to the direction of the shaft hole 13*f* is applied to the tip portion 13*c* of the oscillating plate 13, the tip of the spring portion 13*e* abuts on the shaft 13*a* pierced into the shaft hole 13*f* and bends, and becomes capable of making displacement in response to load. In FIGS. 5, 6, this displacement is performed on the side of the oscillating plate 12.

Figure 8:
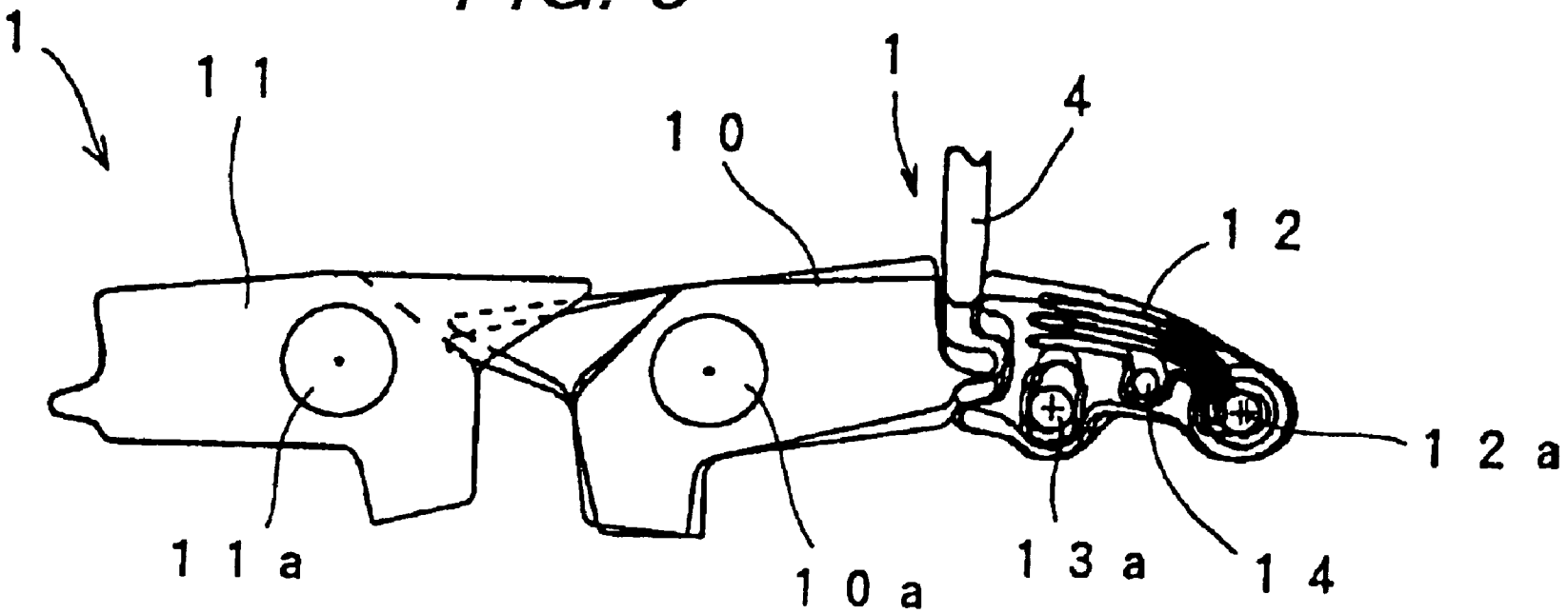
FIG. 8 is a partial front view showing a state where engagement of the pin 4 is released when the yarn carrier 1 of FIG. 1 is stopped by another yarn carrier 1.

FIG. 8 shows an operation of releasing engagement of the pin 4 when another yarn carrier 1 abuts on the yarn carrier 1 stopped by the stopper 15 of FIG. 4 and stops, by the use of a plurality of displacement states. As described here, at the end of the yarn guide rail 2, it is possible to stop a plurality of yarn carriers 1 and release engagement of the pin 4. The releasing operation is the same as in a case where the yarn carrier 1 is stopped by the stopper 15 independently as shown in FIGS. 5, 6.

Figure 9:
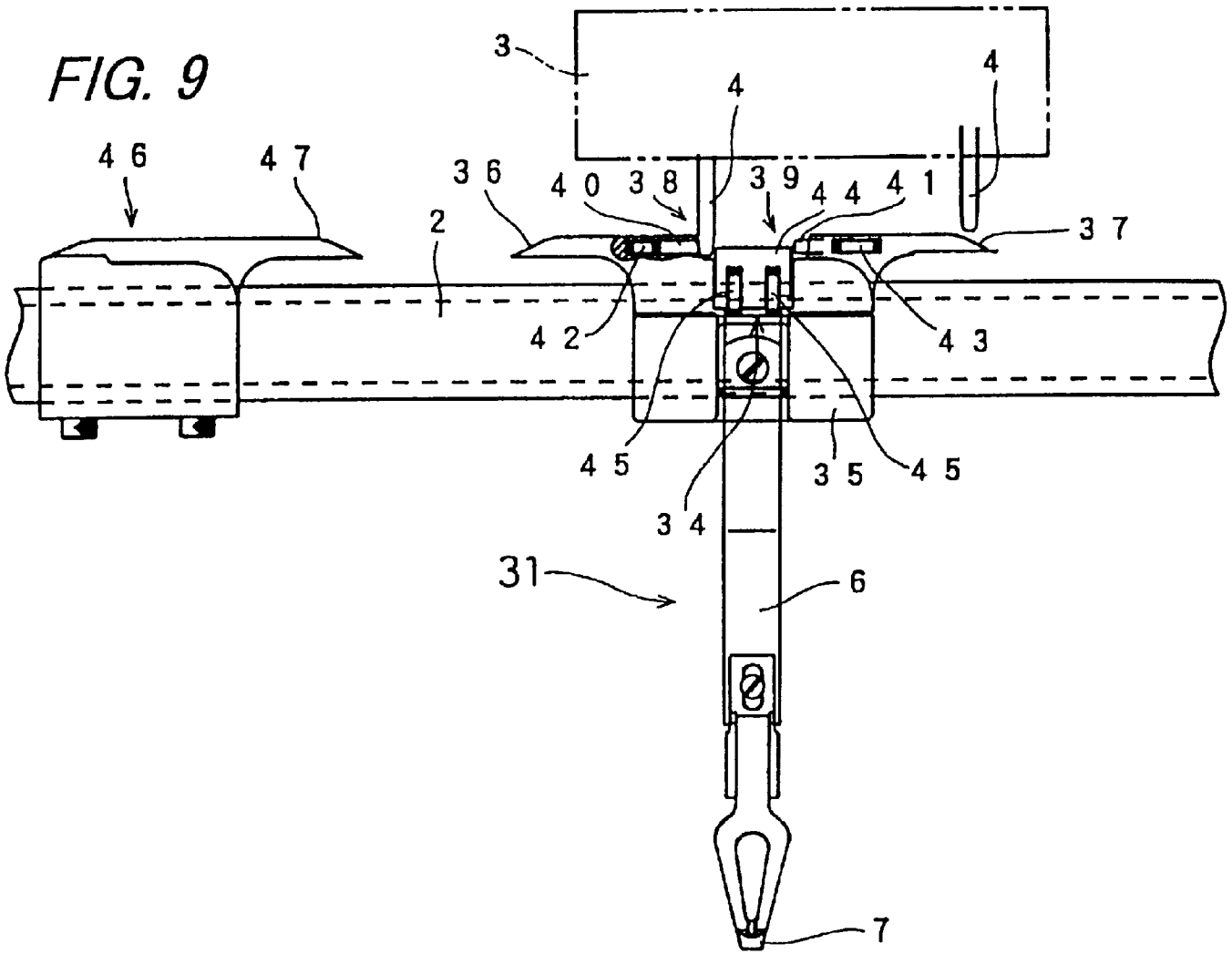
FIG. 9 is a front view showing, in section, part of a schematic construction of a yarn carrier 31, which is another embodiment of the invention.
Figure 11:
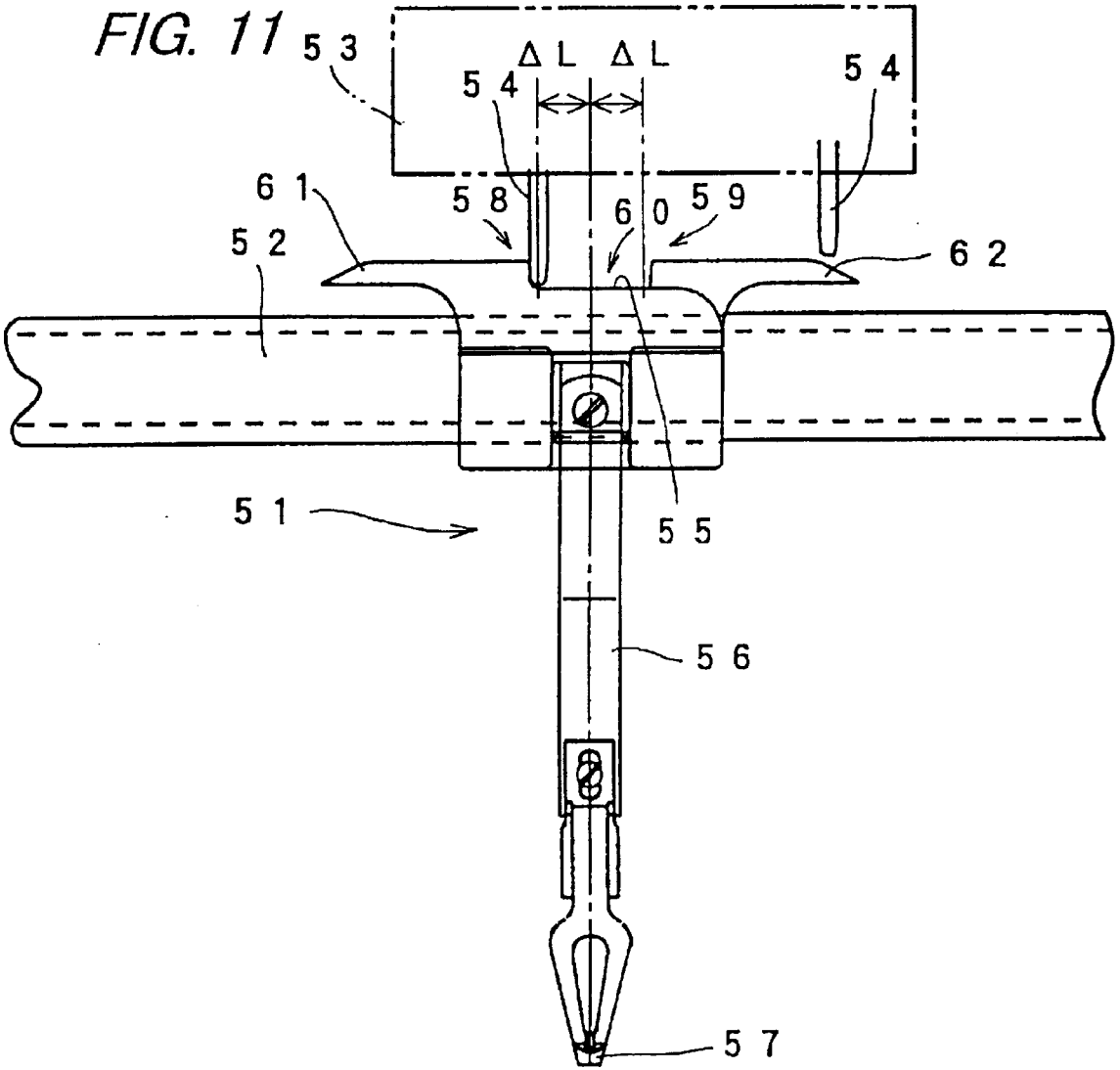
FIG. 11 is a front view showing a schematic construction of a conventional yarn carrier.

FIG. 9 partially shows, in section view, a schematic construction of a yarn carrier 31, which is another embodiment of the invention. Components thereof corresponding to those of the embodiment of FIG. 1 are denoted by the same reference numerals, and overlapping explanation is omitted. The yarn carrier 31 of this embodiment is provided with guiding slopes 36, 37 the same as shown in FIG. 11 on both sides of a casing 35 having a concave part 34. Two engagement points 38, 39 are disposed on both sides of the concave part 34. In the engagement points 38, 39, protruding pieces 40, 41 serving as selection guiding members are biased by springs 42, 43, respectively, and protrude. In the middle of the concave part, as a guide blocking mechanism, an ascending and descending member 44 and a spring 45 are disposed. Regarding this yarn carrier 31, a stopper 46 is placed at the end of the yarn guide rail 2. The stopper 46 has a guiding slope 47.

Figure 10:
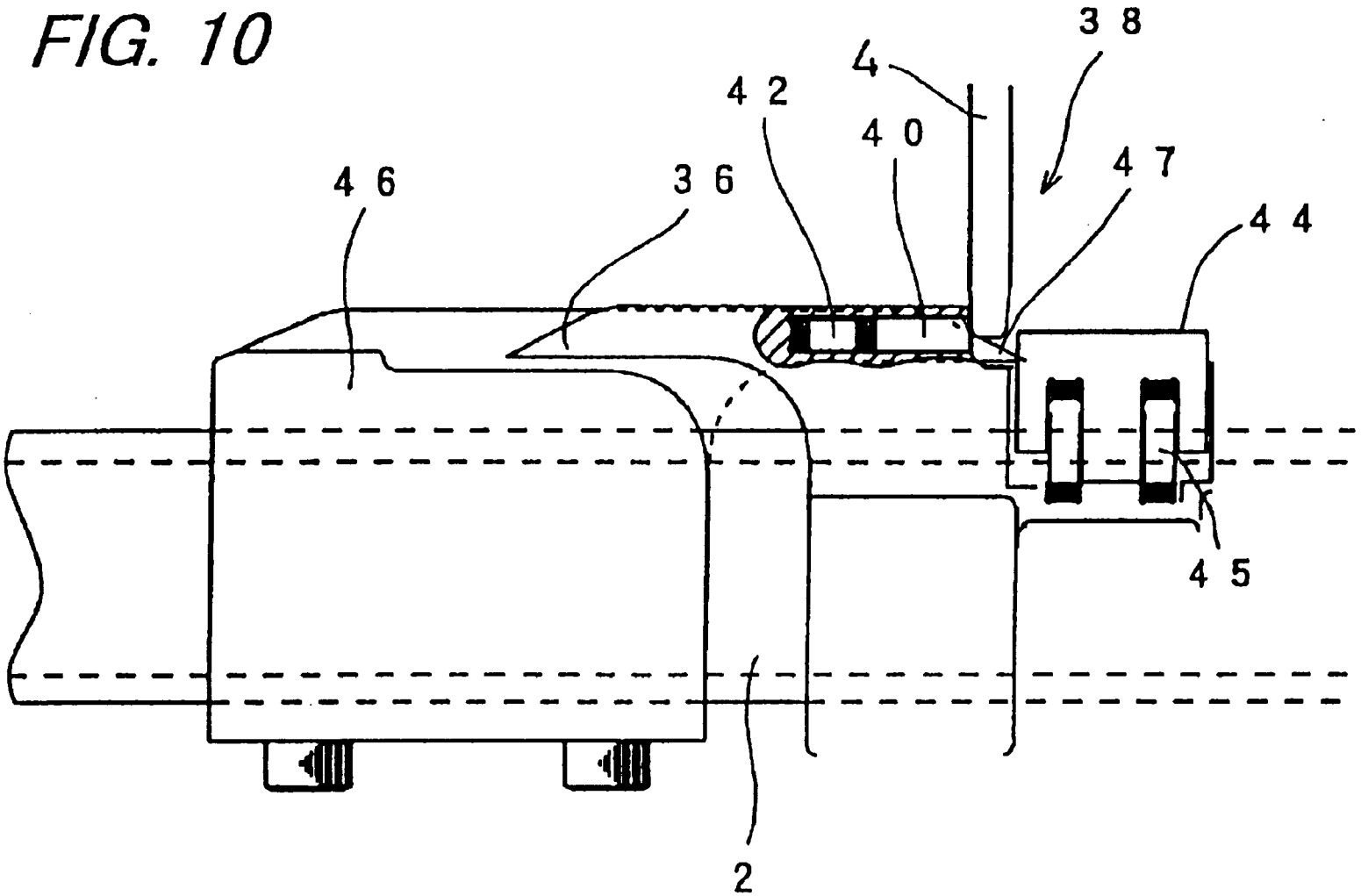
FIG. 10 is a partial front view showing a state where engagement of the pin 4 is released when the yarn carrier 31 of FIG. 9 is stopped by a stopper 45.

FIG. 10 shows a state of releasing the pin 4 from engagement by the guiding slope 47 when stopping the yarn carrier 31 at the stopper 46. The guiding slopes 36, 37, 47 are placed symmetrically about a point in the same manner as in FIG. 2, and capable of making the tips run into each other.

In this embodiment, when the carriage 3 approaches with the pin 4 protruding in order to select the yarn carrier 31, engagement is blocked by the protruding piece 41 in the engagement point 39 on the rear side in the running direction, and the tip portion of the pin 4 abuts on the upper face of the protruding piece 41 and is guided to the front side in the running direction. In the front-side engagement point 38, the pin abuts on the tip portion of the protruding piece 40 and pushes in the protruding piece 40, thereby being capable of engagement.

Further, when the pin 4 is prevented from being engaged with the engagement point 39 on the rear side in the running direction and passes by the rear-side engagement point, the pin 4 is guided forward while the tip of the pin 4 abuts on the upper face of the ascending and descending member 44. Since pressure to the ascending and descending member 44 stops when the pin 4 reaches the front-side engagement point 38, the ascending and descending member 44 ascends by bias of the spring 45, and can engage the rear side of the pin 4 on the front-side side end face thereof.

The invention can be combined with a method of moving a yarn carrier as disclosed by the applicant of this application in Japanese Patent No. 2903152. It is possible to provide means for enabling a new knitting operation by placing a plurality of yarn carriers on a single path and freely moving a yarn carrier which is not hauled by a carriage without affecting a yarn carrier hauled by the carriage.

In the respective embodiments described above, a knitting needle is operated by action of a cam within the carriage 4. However, the carriage 4 that the invention can be applied to only needs to be a table which can cause a pin hauling the yarn carrier 1, 31 to appear, and there is no need that it is integrally equipped with a cam for knitting by all means.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

[Industrial Applicability]

As described above, according to the invention, the selection guiding member guides the pin so as to pass by the engagement point on the rear side in the running direction of the carriage. The guide blocking mechanism guides the pin guided by the selection guiding member so as to pass by the rear-side engagement point, toward the engagement point on the front side in the running direction, and prevents the pin from moving on the rear side when the pin reaches the front-side engagement point. Since the selection guiding member disposed to the front-side engagement point does not guide the pin having reached so as to pass forward, the pin is engaged with the front-side engagement point and prevented from moving on the rear side, and therefore, it is possible to certainly stop the yarn carrier when the carriage stops. As a result, there is no need to increase sliding resistance between the yarn carrier and the yarn guide rail or the like, and it is possible to move the yarn carrier with light load to the yarn guide rail or the like.

Further, according to the invention, the tip of the pin makes contact with and pressures the guide portion on the upper face of the arm of the selection guiding member, and causes the arm of the selection guiding member to make oscillation displacement, whereby it is possible by the tip portion of the arm to prevent the pin from being engaged with the front-side engagement point. In the front-side engagement point, by causing the tip of the pin to abut on the tip portion of the selection guiding member, it is possible to engage the pin.

Still further, according to the invention, the oscillating member whose tip portion fronts the engagement point on the rear side in the running direction of the carriage guides the pin prevented from being engaged with the rear-side engagement point along the guide portion on the upper face, and guides to the guide portion on the upper face of the oscillating member whose tip portion fronts the front-side engagement point. While pressuring and pressing down the oscillating member, the pin reaches the front-side engagement point. Since pressure to the oscillating member is stopped, the tip portion of the oscillating member ascends, and can be engaged with the rear side of the pin.

Still further, according to the invention, when load is applied to the front side of the pin engaged from both sides in the running direction, the oscillating member is displaced toward the shaft thereof, so that it is possible to easily detach the pin from the front-side engagement point. For example, by disposing a stopper or the like at the end of the yarn guide rail, it is possible to release the yarn carrier from the engagement state only by moving the carriage toward the end from the stopper.

Still further, according to the invention, it is possible by the selection guiding member protruding to the engagement point on the rear side in the running direction, to guide the pin so as to pass by without being engaged. Since the pin abuts on the tip portion of the selection guiding member in the front-side engagement point, it is possible to push the selection guiding member into the concave part and engage.

Still further, according to the invention, the ascending and descending member is capable of guiding the pin forward on the upper face thereof abutting on the tip of the pin guided so as to pass by the engagement point on the rear side in the running direction, and, after the pin reaches the front-side engagement point, ascending due to bias of the spring and engaging the rear side of the pin on the front-side side end face thereof.

What is claimed is:

1. A yarn carrier of a weft knitting apparatus which yarn carrier is selected by protruding a pin disposed to a carriage moving to one side or another side along a longitudinal direction of a needle bed of the weft knitting apparatus and capable of appearing, provided with two engagement points where a tip of the pin can be engaged spaced in the longitudinal direction in order to supply knitting yarn to the vicinity of a tip of a knitting needle performing a knitting operation, engaged with the tip of the pin in the engagement point on a front side in a running direction of the carriage, and hauled and moved by the carriage, the yarn carrier of the weft knitting apparatus comprising:

a pair of selection guiding members which are disposed so as to front the individual engagement points from the outside of the two engagement points in the longitudinal direction, respectively, and which selectively guide the pin so as to pass by the engagement point on a rear side in the running direction of the carriage and so as not to pass by the engagement point on the front side in the running direction of the carriage; and a guide blocking mechanism, disposed between the two engagement points, which guides the pin guided by the selection guiding member so as to pass by the engagement point on the rear side in the running direction to the engagement point on the front side in the running direction and which, when the pin reaches the front-side engagement point, makes displacement so as to prevent the pin from moving on the rear side relatively to the engagement point.

2. The yarn carrier of the weft knitting apparatus of claim 1, wherein regarding the selection guiding members:

arms thereof are capable of making oscillation displacement about shafts disposed outside the engagement points so as to be perpendicular to a protruding direction of the pin and the running direction of the carriage, the arms extending from the shafts toward the engagement points;

on the upper faces of the arms, guide portions with which the pin makes contact when approaching the engagement point and which guide the tip of the pin to the engagement point while making oscillation displacement downward due to pressure of the tip of the pin are formed;

tip portions of the arms front the engagement points, and are capable of narrowing the engagement points by making oscillation displacement to prevent the tip of the pin from being engaged with the engagement point when the guide portion is pressured, and abutting on the tip of the pin to engage the pin with the engagement point when the guide portion is not pressured; and the arms are biased by smaller force than the pressuring force of the pin so that the guide portions make oscillation displacement upward.

3. The yarn carrier of the weft knitting apparatus of claim 2, wherein the guide blocking mechanism has a pair of oscillating members which are disposed between the two engagement points and whose arms are capable of making oscillation displacement about shafts parallel with shafts of the selection guiding members, the arms extending from the shafts toward the engagement points;

the respective oscillating members have, on the upper faces of the arms, guide portions which guide the tip of the pin while making oscillation displacement downward due to pressure of the tip of the pin, from the rear-side engagement point where the pin is prevented from being engaged by oscillation displacement of the selection guiding member, to the front-side engagement point; and tip portions of the arms front the engagement points, when the tip portion of the selection guiding member is pressed down, are pressed down together, and when the pin passes by the tip portion to be engaged with the front-side engagement point, makes oscillation displacement upward to catch the pin with the tip portion of the selection guiding member.

4. The yarn carrier of the weft knitting apparatus of claim 3, wherein the oscillating member is capable of making displacement toward the shaft when load more than a predetermined standard is applied from the tip portion of the arm.

5. The yarn carrier of the weft knitting apparatus of claim 1, wherein the selection guiding members are housed in concave parts disposed outside the engagement points, and capable of appearing to the respective engagement points, and guide so as to pass by the engagement point while the upper faces thereof abut on the tip of the pin in the state of protruding to the engagement points, and include springs which biases the selection guiding members so as to protrude from the concave parts toward the engagement points.

6. The yarn carrier of the weft knitting apparatus of claim 5, wherein the guide blocking mechanism includes an ascending and descending member which is disposed below between the two engagement points and capable of making ascent and descent displacement and springs which bias the ascending and descending member upward, and guides the pin from the engagement point on the rear side in the running direction to the front-side engagement point in the state pressed down by the pin while the upper face of the ascending and descending member makes contact with the tip of the pin; and when the pin reaches the engagement point on the front side in the running direction, abuts on the tip of the selection guiding member and pushes the selection guiding member back into the concave part, and pressure to the upper face of the ascending and descending member by the pin is stopped, the ascending and descending member ascends, and the tip of the pin is caught between a side end face on the front side in the running direction and the tip of the selection guiding member on the front side of the engagement point.

* * * * *

UNITED STATES PATENT AND TRADEMARK OFFICE

CERTIFICATE OF CORRECTION

PATENT NO. : 6,895,785 B2
DATED : May 24, 2005
INVENTOR(S) : Toshiaki Morita

It is certified that error appears in the above-identified patent and that said Letters Patent is hereby corrected as shown below:

Title page,
Item [54], Title, please replace "DEVICE" with -- APPARATUS --.

Signed and Sealed this

Sixteenth Day of August, 2005

JON W. DUDAS
*Director of the United States Patent and Trademark Office*